United States Patent [19]

Buchheit, Jr.

[11] Patent Number: 5,063,713

[45] Date of Patent: Nov. 12, 1991

[54] SURFACE ABRADING AND PARTICLE COLLECTION DEVICE

[75] Inventor: Gerald A. Buchheit, Jr., Orchard Park, N.Y.

[73] Assignee: Accent Stripe Inc., Orchard Park, N.Y.

[21] Appl. No.: 630,559

[22] Filed: Dec. 20, 1990

[51] Int. Cl.[5] ..... E01C 23/08

[52] U.S. Cl. ..... 51/170 R; 51/174; 51/258; 51/273; 299/39

[58] Field of Search ..... 51/170 R, 174, 170 PT, 51/273, 176, 177, 258; 299/39, 64; 404/90, 91

[56] References Cited

U.S. PATENT DOCUMENTS

| | | | |
|---|---|---|---|
| 1,013,534 | 1/1912 | Cheney | 51/273 |
| 1,560,658 | 11/1925 | Bull | 51/273 |
| 3,107,460 | 10/1963 | Staehlin | 51/176 |
| 3,146,558 | 9/1964 | Viescas | 51/273 |
| 3,598,446 | 8/1971 | Hatcher | 51/176 |
| 3,608,968 | 9/1971 | Burnett | 51/176 |
| 3,701,221 | 10/1972 | Vinella | 51/273 |
| 3,802,742 | 4/1974 | Zuzelo | 299/39 |
| 4,583,327 | 4/1986 | Jaeggi | 51/178 |
| 4,723,867 | 2/1988 | Wirtgen | 299/39 |
| 4,909,575 | 3/1990 | Lupton | 299/39 |

FOREIGN PATENT DOCUMENTS

| | | | |
|---|---|---|---|
| 850946 | 10/1960 | United Kingdom | 51/174 |

*Primary Examiner*—Roscoe V. Parker

*Attorney, Agent, or Firm*—Sommer, Oliverio & Sommer

[57] ABSTRACT

A device for abrading road markings along a road surface and for collecting the particulate therefrom. The device includes a frame 11 to which is appended a series of independently controllable abrading devices 18A–D capable of independent actuation by an operator in an enclosed selectively positionable cab 15. The abraders are adapted to rotate along the road surface to be abraded and effectively grind the present road markings into particulate. Thereafter, the collection system consisting of a collection tube 20, bag house 21 and disposal hopper 24 creates a suction force through the system through the use of suction fan 22. Accordingly, the abrading particulate is drawn through the collection system into the bag house where it is filtered by internal suspended filters 27 and is ultimately discharged through the use of an appended conveyor 25 into hopper container portion 77.

3 Claims, 3 Drawing Sheets

SURFACE ABRADING AND PARTICLE COLLECTION DEVICE

TECHNICAL FIELD

This invention relates generally to the field of road repair and maintenance devices and specifically, to a device for abrading traffic markings from the surface of a road or highway while simultaneously collecting the ground particulate therefrom.

BACKGROUND OF THE INVENTION

Maintenance of roadways, especially highways and turnpikes, is critical to the safe and orderly passage of vehicular traffic through the infra-structure. Included within the scope of routine roadway maintenance is the consistent integrity of roadway markings, including lane lines, shoulder lines and other surface markings used to delineate traffic channels and ensure an orderly and safe traffic pattern. The integrity of these markings is, of course, critically important to the safe operation of vehicles over the roadway.

The primary maintenance problem associated with the markings is wear attributable to roadway traffic, weather, including moisture, precipitation, ice, snow, etc., and a variety of other factors causing abrasion or erosion of the road surface which is generally comprised of asphalt, macadam, concrete or similar materials. To this end, various synthetic products and resin-based polymers have been developed as substitutes for traditional "road paint" to increase the longevity of road markings, thereby reducing the need for constant maintenance.

The present invention provides a device that automatically abrades existing road markings from the road surface, while simultaneously suctioning and containing the particulate resulting from the grinding process thereby permitting new markings to be readily sprayed or painted onto the road surface. The present invention provides a more practical and efficient alternative to the use of solvents or other hand-held devices and results in abraded surfaces amenable to repainting or spraying with more desirable resin based materials for markings of expanded longevity.

Further, the instant device is capable of abrading markings on either side of a roadway and various positions therealong without reversing the direction of travel by inclusion of abraders on each side of the device, each independently operable by the device operator while seated in the enclosed cab area. Moreover, the device and attendant collection system permits abrading of the road surface without an inordinate release of particulate or dust into the traffic area by providing a system for collecting the particulate in a hopper or bin adapted for easy disposal.

The prior art, including a predecessor device developed by the applicant, suffers from various deficiencies. In particular, the prior art devices are only capable of abrading along a single line and do not have a series of abraders easily adaptable to removal of markings at various points along a particular road surface without changing the direction of travel. Moreover, the prior art devices do not include a transversely moveable enclosed cab for the operator thereby exposing the operator to the elements, including dust and particulate matter produced by the abrading process, as well as an inordinate amount of irritating noise and vibration from the device. The known prior art also does not include a particulate or dust collection system and accordingly, the abraded particulate is either dispersed into the air surrounding the device (and into lanes of outgoing or incoming traffic) or remains along the road surface requiring further cleaning or washing prior to the repainting of any markings. Accordingly, the prior art devices are inefficient, environmentally unsound, disruptive of traffic, and expose the operator to harsh operating conditions. Moreover, the prior art devices, on account of a lack of efficiency, result in a significant expenditure of time to prepare the surface for remarking or painting.

Accordingly, the instant invention solves the problems of the prior art by providing a flexible, adaptable device capable of rapidly and efficiently abrading a road surface while simultaneously collecting and removing any abraded dust and particulate matter from the road area. The device further accomplishes this result without exposing the operator to environmental risks and with minimal disruption of traffic patterns and traffic flow.

DISCLOSURE OF THE INVENTION

With parenthetical reference to the drawing figures, the invention generally provides a device (e.g. 10) for abrading road surface markings and simultaneously collecting the abraded dust and particulate therefrom.

The device generally includes a frame (e.g. 11) for supporting the components of the invention; front steerable drive wheels (e.g. 12) powered by a diesel or gasoline engine (e.g. 14) and rear wheels (e.g. 13) for transporting and positioning the frame along the road surface; an enclosed cab (e.g. 15) mounted on parallel transversely mounted frame tracks (e.g. 16) allowing an operator to locate and position the device along the surface to be abraded; a series of hydraulically powered dual abraders (e.g. 18A– D) suspended between the frame and road surface to be abraded; and a particle collection and containment system (e.g. 19) for suctioning abraded particles and containing the same during the course of operation of the device.

The collection and containment systems specifically includes a main collection tube (e.g. 20) communicating with the bottom of a vacuum bag house (e.g. 21), having suspended filters (e.g. 27) and an attendant suction fan (e.g. 22); flex connecting tubes (e.g. 23) joining the main collection tube and abrader pairs; and a trailing hopper (e.g. 24) and conveyor (e.g. 25) communicating with the support frame and adapted to carry the suctioned particles from the bag house to a hopper container (e.g. 77) for containment.

As set forth in detail below, the device, operated by the enclosed operator, travels along a road surface to be abraded. The abraders are thereafter selectively lowered into position contacting the road surface and, rotating at high speeds, grind into particles a layer of the surface to be abraded. The ground particles, in turn, are suctioned through the collection system and bag house, are filtered, and then are conveyed to the containment hopper during the ordinary course of operation of the device.

Accordingly, the general object of the invention is to provide an efficient road surface abrading device capable of collecting and containing the abraded particles.

A further object of the invention is to provide a road abrading device that will substantially and automatically reduce emission of potentially hazardous particulate and dust into the air around the area of operation.

Another object of the invention is to provide an abrading device that is easily operable and that may be flexibly adapted to abrade road surfaces of various configurations and markings.

These and other objects and advantages of the invention will become apparent from the foregoing and ongoing written specification, the drawings, and the appended claims.

DETAILED DESCRIPTION OF THE INVENTION

Figure 1:
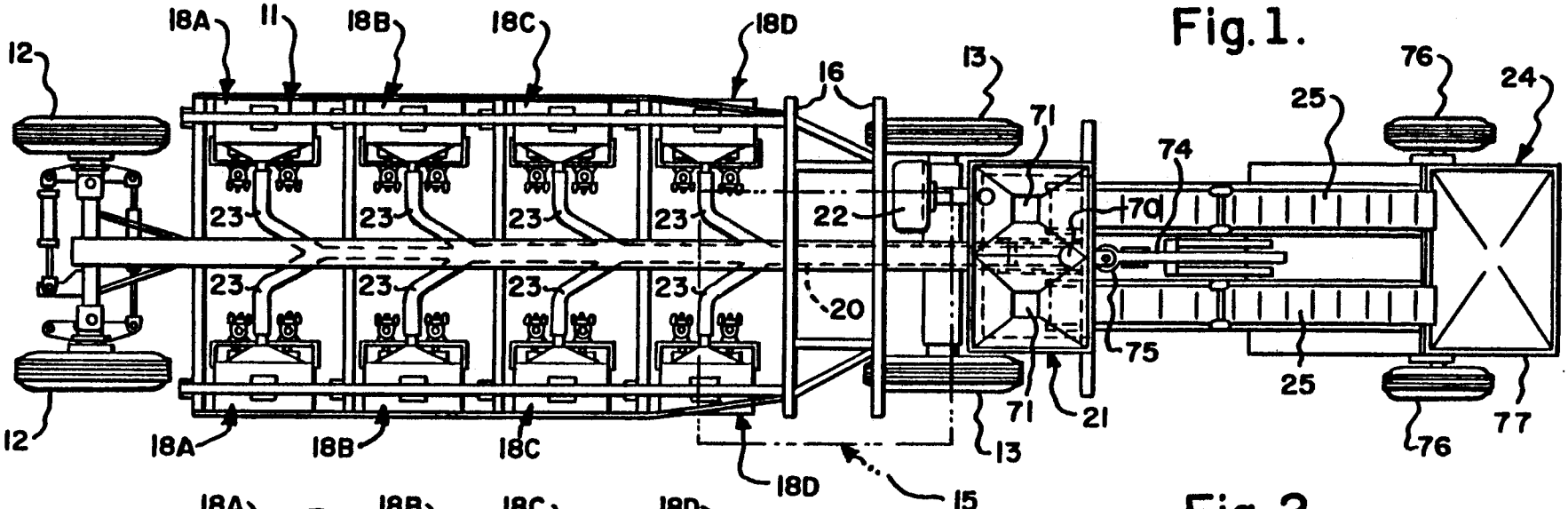
FIG. 1 is a top plan view of the invention.

At the outset, it should be clearly understood that like reference numerals are intended to identify the same structural elements, portions or surfaces consistently throughout the several drawings figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Figure 3:
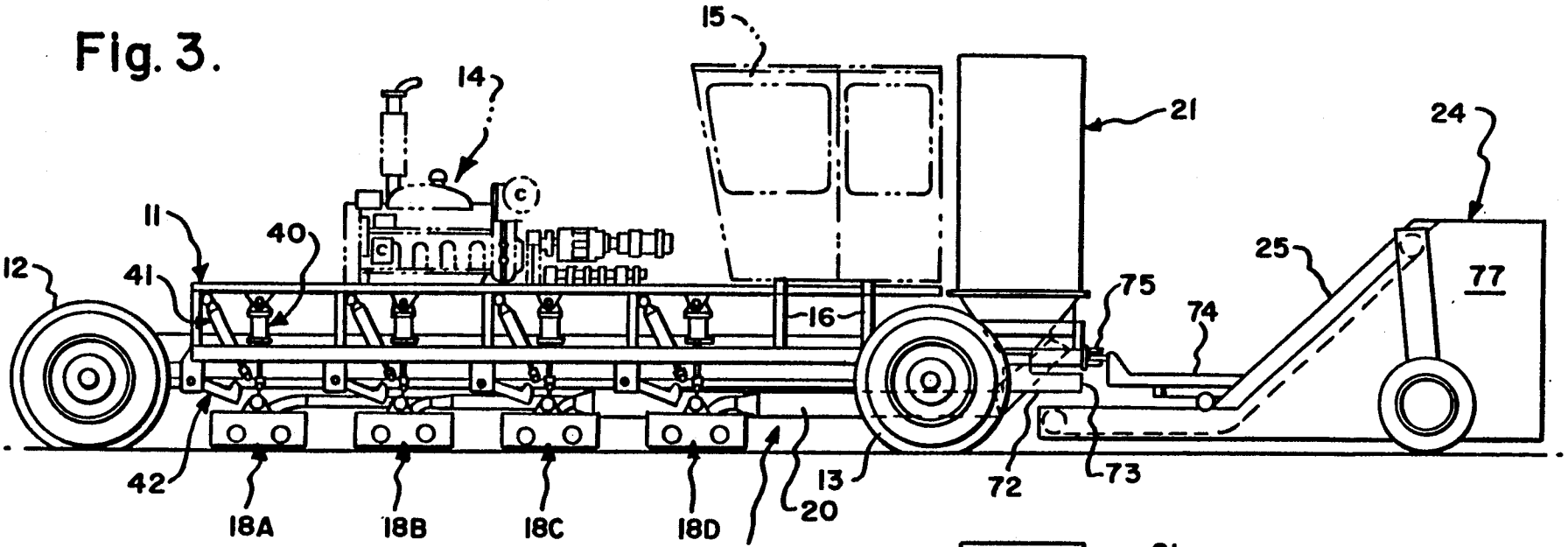
FIG. 3 is a side elevation of the invention showing the components comprising the invention.

Turning first to FIG. 3, the invention is shown to generally comprise a frame 11 having front steerable drive wheels 12, powered by engine 14, rear wheels 13 and an operator cab 15 mounted on a pair of transversely oriented parallel tracks 16. A series of dual abraders 18A-18D, are suspended from the frame on each side thereof by complementary supporting pistons and cylinders, 40,41 and 42. Each abrader pair is adapted to selectively contact the road surface to be abraded. A main collection tube 20 communicates with each of the individual abraders and with the bottom of bag house 21 positioned on the frame behind the cab. A fan 22 creates a suction through the collection tube and into the bag house and, as set forth in detail below, serves to collect the abraded particles resulting from the grinding of the surface to be abraded. A hopper 24 having a conveyor 25 and container 77 is positioned to trail behind the frame and below the bag house and is adapted to convey collected particles from the bag house to the hopper for disposal.

Figure 5:
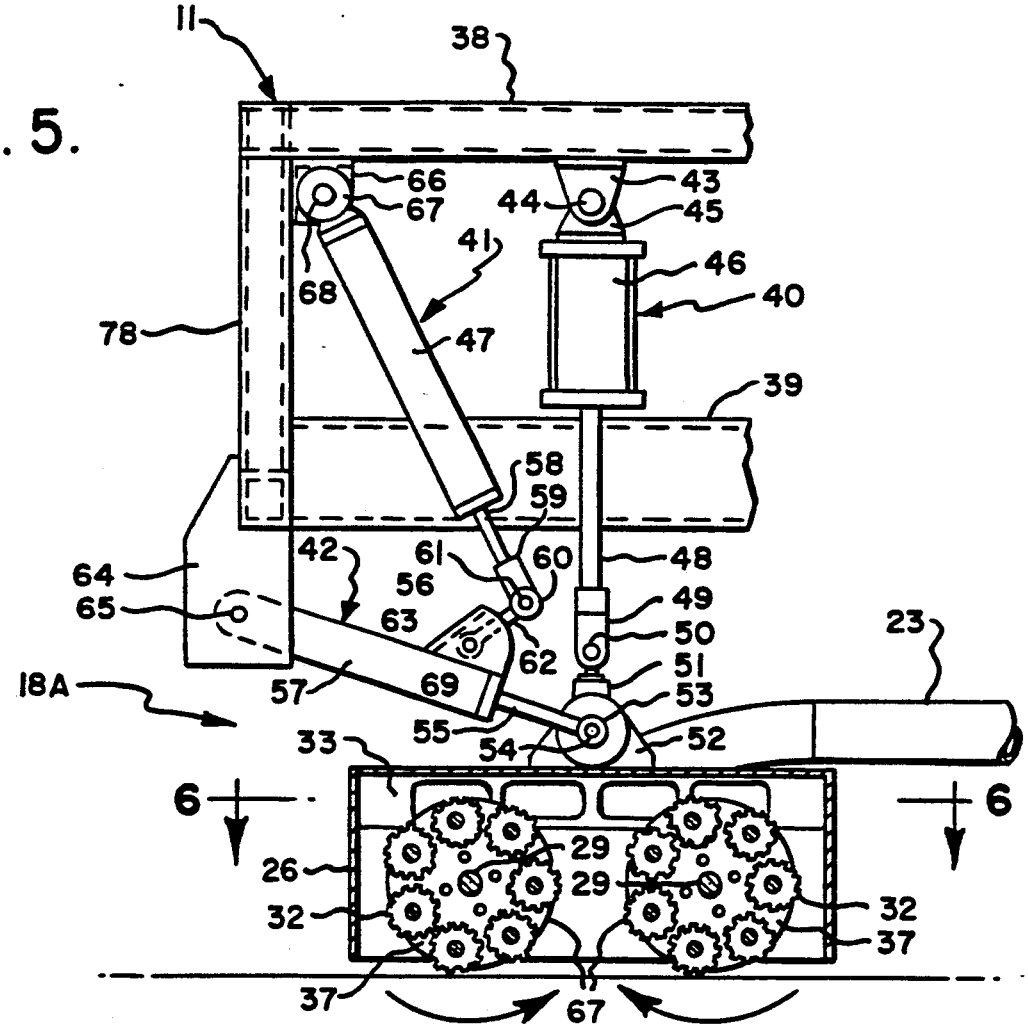
FIG. 5 is an enlarged side elevation of an abrader and suspension thereof taken along 5—5 of FIG. 2.
Figure 6:
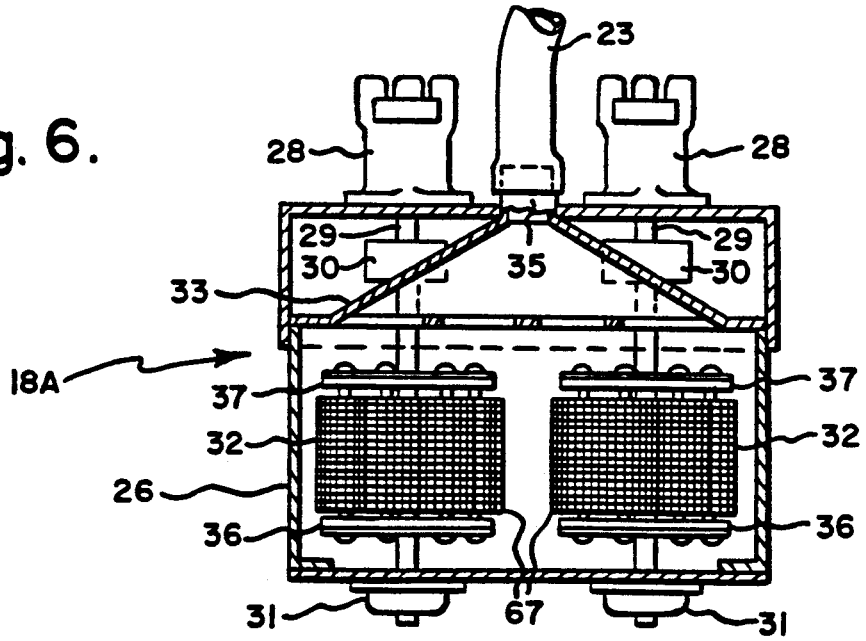
FIG. 6 is a longitudinal sectional view of an abrader taken along 6—6 of FIG. 5.

Turning to FIGS. 5 and 6, the abrader assembly and support structure is shown in detail. In particular, FIG. 6 shows the abrader assembly to be comprised of a substantially rectangular hollow housing 26. A pair of enclosed abrader grinders 67 are comprised of a series of individual cylindrical grinding components 32 arranged in a circular pattern and transversely interposed within the housing by axle mount 29 and flexible coupling 30 extending through the housing and through a center hole in the substantially cylindrical abrader grinder. Accordingly, when mounted on the axle mount, the abrader grinder is free to rotate with the axle mount while each of the grinding components, arranged along the diameter thereof, in turn rotate and contact the surface to be abraded below.

Continuing to advert to FIGS. 5 and 6, the abrader grinder 67 is shown to include a pair of outside surfaces 36 and 37 which provide a housing and support each of the individual grinding components 32 at their ends. Hydraulic abrader drive 28, which is connected to hydraulic supply source and motor 17 (see FIG. 3), is powered to cause the axle mount and impaled abrader grinders to rotate in a selected direction. Accordingly, axle mount 29 is fastened at one end of the housing to hydraulic drive 28 and at the opposite end to mounting nut 31 and is free to rotate the impaled grinders within the housing. As shown in FIG. 5, each pair of abrader grinders rotate in opposite directions inwardly toward the center of the abrader housing. Accordingly, the ground particulate produced by the individual grinding components contacting the surface to be abraded are emitted inwardly in the direction of the arrows in FIG. 5.

Continuing to advert to FIG. 5, support frame 11 is shown to generally comprise a horizontal top member 38 and parallel horizontal bottom member 39, joined at their leftmost ends by vertical side member 78. The support frame and members are shown to generally provide attachment and support means for a series of pistons and cylinders affixed to the top of each abrader housing 26.

In particular, the preferred embodiment shows the abrader housing suspended and supported by three cooperating pistons and cylinders appended to the support frame. Abrader pressure control cylinder 40 is mounted vertically above the center of abrader housing 26 and extends to top member 38. Specifically, pressure control cylinder 40 is attached to the bottom of member 38 by frame mounting plate 43 which is connected to the top of cylinder body 46 through the use of cylinder mounting plate 45 and joining pin 44. Frame mounting plate 43 and cylinder mounting plate 45 are joined by the insertion of joining pin 44 into coinciding through-holes in the frame mounting plate and cylinder mounting plate. As a result, cylinder 40 is free to pivot laterally around the point defined by joining pin 44.

Continuing to advert to FIG. 5, pressure control cylinder 40 is shown to further include rod 48 extending vertically downwardly from cylinder body 46 toward the top of abrader housing 26. Rod 48 terminates at its lower end in a specially configured end mounting portion 49 having a through-hole adapted to receive joining pin 50. Abrader housing 26 has, centered on its top surface, a specially configured housing mounting plate 52 extending upwardly and terminating at its upward end in a mounting collar 51 adapted to also receive joining pin 50. In particular, rod end mounting portion 49 and upper collar portion 51 have coincidental through-holes for accepting joining pin 50. Accordingly, abrader housing 26, suspended from the lower portion of rod 48, is free to pivot laterally around joining pin 50. Further, as previously described, the entire assembly (i.e., piston 40, rod 48 and appended abrader housing 26) is free to pivot laterally around joining pin 44. Accordingly, the abrader housing, and enclosed grinding components, have a great amount of lateral movement capability notwithstanding ultimately being suspended from the support frame.

Pressure control cylinder 40 is typically air actuated from a remote source (not shown) and is adapted to exert vertical downward pressure upon the abrader housing, in turn, increasing the vertical contact force of the enclosed abrader grinding components against the surface to be abraded. In this way, the abrading system may be selectively adjusted to remove varying degrees of road surface and attendant markings and further, may also be adjusted to conform with various road surfaces or road camber. Moreover, abrader pressure control cylinder 40, when raised into a retracted position, serves to somewhat lift the abrader housing and enclosed components from the surface to be abraded.

Continuing to advert to FIG. 5, the support frame further provides attachment and support for hydraulic elevating cylinders 41 and 42 which, acting together and with pressure control cylinder 40, serve to permit abrader housing 26 to be lifted off the surface to be abraded and away from any road obstruction for easy travel of the device. In particular, vertical hydraulic elevating cylinder 41 is comprised of cylinder body 47 which is secured to top member 38 and side member 78 of support structure 11 by mounting plate 66, attached between top member 38 and side member 78, and by cylinder top mounting disk 67 and joining pin 68 which is placed into coincidental through holes of the mounting plate and mounting disk. Vertical hydraulic elevating cylinder 41 further includes rod 58 extending substantially vertically downwardly which, at its lower end, includes a rod mounting plate 59 adapted to receive joining pin 61.

As is shown in FIG. 5, horizontal hydraulic elevating cylinder 42 is comprised of cylinder body portion 57 and extending rod 55. In particular, the cylinder portion is pivotally mounted to lower member 39 and side member 78 of the support frame through the use of a specially configured substantially rectangular and vertically downwardly extending mounting plate 64 using joining pin 65 extending through the top portion thereof of cylinder 57. Horizontal elevating hydraulic cylinder rod 55, at its lower end portion, includes an enlarged cylindrical mounting disk 53 capable of receiving another joining pin 54 there- through. Joining pin 54, in turn, is adapted to be received in a coincidental through-hole in the center portion of abrader housing mounting plate 52. Accordingly, horizontal hydraulic elevating cylinder 42 is free to pivot at its uppermost cylinder end around joining pin 65 and also, is free to pivot at its lower end around joining pin 54.

Continuing to advert to FIG. 5, cylinder portion 57 further includes a generally upwardly extending specially configured mounting plate 56 on the top surface thereof having a through-hole capable of accepting joining pin 63. Vertical hydraulic elevating cylinder 41 and horizontal hydraulic elevating cylinder 42 are connected by connecting rod 62 which, at one end, is mounted using mounting disk 60 and at its other end mounting disk 69 and joining pins 61 and 63 therethrough. Accordingly, vertical hydraulic elevating cylinder 41 is free to pivot at its lower end around joining pin 61 and around joining pin 63.

In operation, as cylinders 40 and 41 are retracted, cylinder 41 pivots at its lower end around joining pins 61,63, and at its upper end around joining pin 68 while cylinder 42 pivots around pin 65,53. Thereafter, as each of the cylinders is retracted, the effect is to lift the abrader housing 26 and enclosed abrader grinder 67 up and away from the surface to be abraded. Together, cylinders 40, 41 and 42 hold the housing and abrader components in place above the surface to be abraded thereby permitting free travel of the device across the roadway. Conversely, in operation, the cylinder rods may be extracted, thereby lowering the abrader housing and abrader components into position until contacting the surface to be abraded. In addition, the various flexible pivot points permit the abrader housing and enclosed components to adjust laterally to road variations and to the frictional forces produced by the abrading operation described below, thereby alleviating severe effects of fatigue on the components and support frame.

Figure 4:
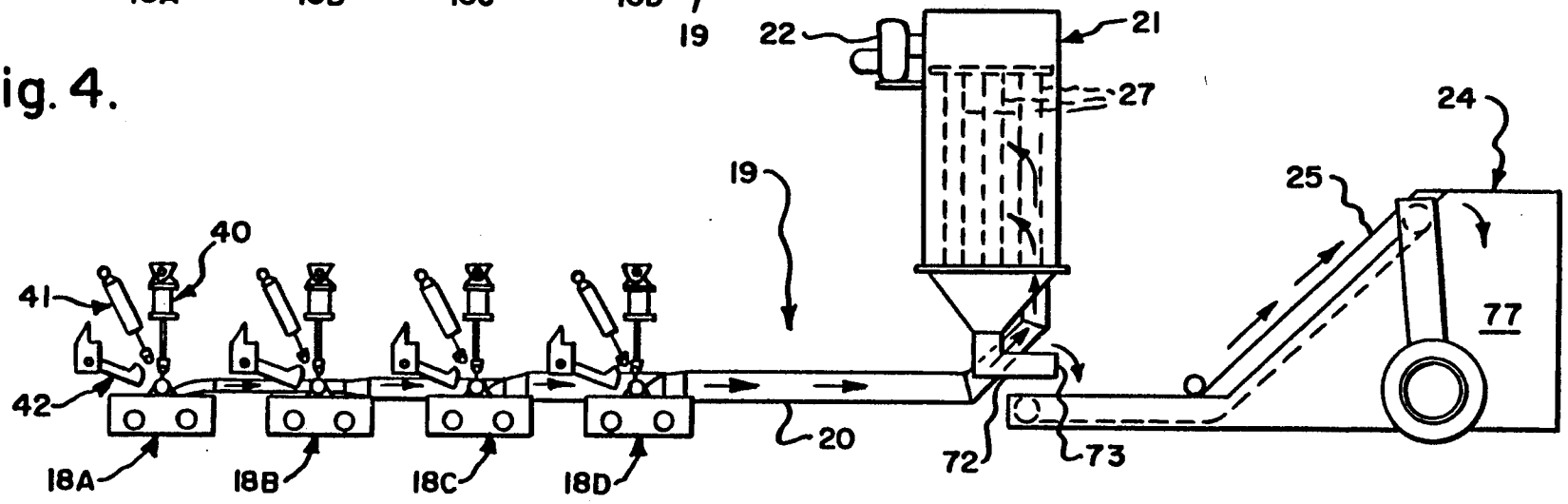
FIG. 4 is a side elevation of the collection and containment system only.

Adverting now to FIG. 4, collection system 19 is shown to generally include the abrader pairs 18A–D, each communicating with main collection tube 20 by individual flex connecting tubes 23 extending therefrom into abrader housing 26. Specifically, referring to FIG. 6, abrader housing 26 is shown to include at its inwardly facing end and enclosed collection duct 33 of triangular cross-section. The "open" or "mouth" portion of the collection duct is interposed directly behind and above the abrader grinding components and is therefore arranged to communicate with the area surrounding the same. The collection duct exits the enclosed abrader housing through a circular opening and throat portion 35 and, at its end, is shown to communicate with flexible connecting tube 23 which, in turn, communicates with main collection tube 20.

Figure 2:
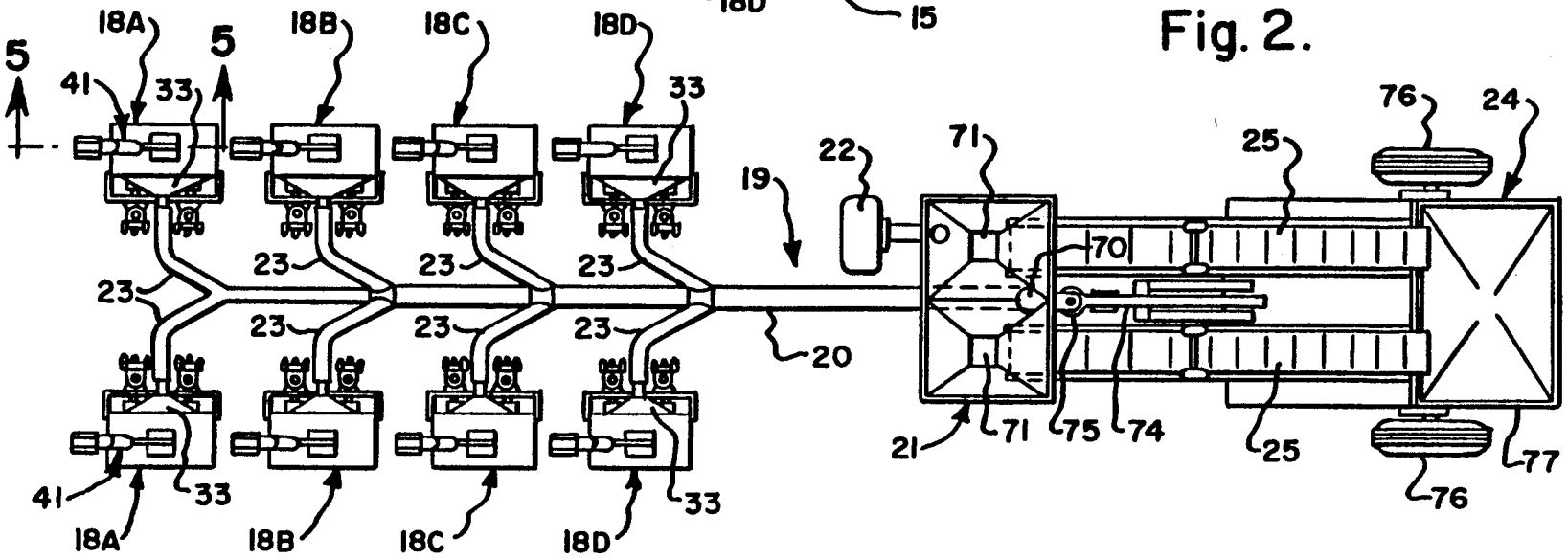
FIG. 2 is a top plan view of the invention showing only the collection and containment system.

Collection tube 20 runs the length of the device and communicates with each of the four pairs of abraders shown in the preferred embodiment of the invention (see FIGS. 1 and 2). In turn, the rear-most end of the collection tube is angled slightly upwardly and communicates with the bottom of bag house 21 through opening 70 adapted to receive the end of collection tube 20 therein. Suction fan 22 is interposed near the bottom portion of bag house 21 and serves to create a drawing suction force through the length of the main collection tube through opening 70. Bag house 21 further includes opening 71 located at its immediate bottom portion. Rightwardly facing elbow-shaped discharge tube 72 extends from opening 71 horizontally rightwardly and terminates in opening 73. Trailing the collection system and device is disposal hopper 24 which is supported and is capable of rolling with the device on a pair of wheels 76. The disposal hopper includes a container portion 77 communicating with a specially configured conveyor 25, which extends from below bag house 21 and appended discharge tube opening 73 to the top of container 77.

In FIGS. 2 and 3, hopper 24 is shown to be connected to the main frame of the device through the use of horizontally extending connecter arm 74 and connecter mechanism 75 which joins the trailing hopper to the rear of the device frame. Connecting mechanism 75 is specifically designed so that the hopper is free to pivot laterally and accordingly, is able to be pulled by the device along a straight line as well as through turns or curves.

Adverting to FIGS. 2 and 4, in operation, the collection system provides a drawing suction force from fan 22 through the abrader housing 26, collection duct 33 and flex tube 23 to main collection tube 20 and, in turn, into bag house 21. Accordingly, the abraded particulate remaining along the surface to be abraded and on the grinding components (described below) are substantially drawn through the collection system into the bag house. Once in the bag house, a series of suspended filters 27 serve to filter and collect certain portions of the particulate, while the remaining portions fall toward the bottom of the bag house through opening 71 and eventually are discharged through opening 73 of discharge tube 72. Thereafter, the discharged particles fall along conveyor 25 and are lifted to the top of hopper container portion 77 and dropped therein at the end of the conveyor. The hopper container portion may then be emptied at a convenient time. Accordingly, the collection system serves to remove the particulate from the surface to be abraded and also, substantially reduces any particulate emissions from the abrading process.

Adverting now to FIGS. 1 and 3, the device is further shown to include an operator cab 15 positioned on a pair of parallel transversely mounted tracks 16. Specifically, the cab includes a convenient place for the operator to sit when operating the device and further, includes the controls for the powering of the device, as well as the controls for the abraders and collection system. Moreover, the cab portion is provided with a mechanism for selectively positioning the cab anywhere along the length of parallel transverse rails 16, thereby giving the operator a line of sight along the same viewing angle as that of each line of parallel abraders. Accordingly, the moveable cab affords the operator the opportunity to carefully and correctly position the operative set of abraders over the portion of the surface to be abraded while keeping the device "on line" during operation. This, of course, makes the abrading process far more efficient and avoids mis-abrading of unmarked surfaces.

In general operation, the device is transported or driven (with the abraders in a retracted position) to an area of highway or roadway needing line abrasion or line remarking. When at the job-site, the operator positions the device appropriately over the markings to be abraded by electing which of the set of abraders pairs (i.e., left or right side) can be most conveniently operated under the circumstances. Contemporaneous with the positioning of the abraders, the operator is able to slide the cab along the set of transversely mounted parallel rails to a position such that the operator's line of sight is along the line of travel of the abraders and along the direction of the line to be abraded. Thereafter, the operator, by engaging the hydraulic and air power sources is able to lower the abraders along the road surface and line marking to be abraded through the use of the pistons and cylinder system. The operator may also vary the downward vertical pressure of the abrader grinders on the surface by actuating the abrader pressure control cylinder to an appropriate level. The collection system and fan is then activated thereby ensuring the suctioning of substantially all fo the particles abraded from the surface and disposal of the same through the use of the conveyor and appended hopper.

When the device is in position, the operator further activates the hydraulic power source causing the abrader grinder and grinding components to rotate rapidly within the housing thereby providing a cutting and abrading force along the road surface. The series of four abrader shown and described in the preferred embodiment allow each area of the road marking to be abraded completely and repeatedly as the device travels over the road surface. This ensures efficient and complete abrading of the markings sufficient for later remarking without delay or repetitive abrading procedures. In turn, as the device is guided slowly over the markings, the abraded particles are suctioned and ultimately disposed of into the hopper. This ensures that the abraded surface is relatively and substantially free of particulate and ready for re-marking.

Depending upon the surface conditions and variation, the operator may also vary the vertical downward pressure on the abrader grinders for efficient and even cutting and further, may elect to use either side of the abrader sets, which are separately capable of actuation, and may move the cab along the parallel transverse track to an appropriate position. Moreover, the operator is able to carefully position the device in an appropriate line through use of the front steerable wheels and easily controlled rear drive wheels.

Accordingly, the device is shown in operation to be capable of expedient, efficient and safe abrading of road surface markings without the need for traffic stoppage or attendant environmental concerns. Moreover, the use of a series of abraders capable of separate actuation on each side of the device ensures complete abrasion, as well as flexibility in the direction and placement of the device. Furthermore, the appended collection and disposal system serves to remove substantially all of the particulate from the road surface, but also serves to avoid emission of the particulate into lanes of traffic or into the air. Finally, the device may be operated by a single operator who has access in an enclosed climate controlled cab to controls for operation of the abraders, collection system, cab positioning mechanism and device drive.

Modifications

The present invention contemplates that many changes and modifications may be made. For example, although the preferred embodiment shows and describes four pairs of abraders, an additional or less amount may be used depending upon on the size and complexity of the abrading job. Moreover, although the collection system shown in the preferred embodiment includes a collection plate, bag house and discharge hopper, other collection systems and disposal systems may be more appropriate depending upon the configuration of the device and its intended use.

Similarly, the abrader design disclosed in the preferred embodiment may also be varied without departing from the spirit of the invention. Different types of cutters, housing and suspension and actuation mechanisms may be appropriately incorporated into the device.

Therefore, while the preferred embodiment of the device has been shown and described, and several modifications discussed, persons skilled in the art will readily appreciate that various additional changes and modifications may be made without departing from the spirit of the invention, as defined and differentiated by the following claims.

What is claimed is:

1. A device for abrading into particles a surface to be abraded and for collecting said particles comprising:

a transport frame having a left side and a right side, left and right front steerable rotatable wheels, left and right rear rotatable drive wheels, a cab for enclosing an operator; a motor for powering said support frame, drive wheels and moving said support frame along a surface to be abraded;

one or more abraders, arranged along the left and right sides of said transport frame and suspended vertically downwardly below said transport frame to said surface to be abraded; said abraders further comprising a housing containing one or more circular rotatable abrader grinders, adapted to contact said surface to be abraded and to be rotated at a high speed;

one or more actuators adapted to raise and lower each of said abraders above and to said surface to be abraded;

an abrader pressure control actuator adapted to selectively vary the vertical pressure exerted by the contact of said abrader grinder with said surface to be abraded;

a particle collection system for collecting and containing said abraded particles, said collection system positioned on said transport frame and comprising a bag house and fan, a main connector pipe communicating with said bag house and extending away therefrom; a plurality of flex connectors, communicating with said main connector pipe and adapted to communicate with each one of said abraders; said bag house and fan further adapted to create a suction through said main and flex connector pipes to said abraders for suctioning said abraded particles into said bag house; a storage hopper having a top opening, and communicating with said bag house and further comprising a conveyor from said bag house to said hopper top adapted to carry said suctioned particles into said hopper; said hopper further adapted to engage said transport frame and to travel therewith.

2. The device according to claim 1 wherein said cab is arranged to be variably positioned transversely across the width of said support frame.

3. The device according to claim 1 wherein said storage hopper further comprises a pair of rotatable wheels connected to said storage hopper for travel therewith.

* * * * *